US012215465B2

(12) United States Patent
Penny et al.

(10) Patent No.: US 12,215,465 B2
(45) Date of Patent: Feb. 4, 2025

(54) RAIL JUNCTION ASSEMBLY

(71) Applicant: EMBEDDED RAIL TECHNOLOGY LIMITED, Derby (GB)

(72) Inventors: Charles Penny, Derby (GB); Andrew Foan, Nuthall (GB)

(73) Assignee: EMBEDDED RAIL TECHNOLOGY LIMITED, Derby (GB)

( * ) Notice: Subject to any disclaimer, the term of this patent is extended or adjusted under 35 U.S.C. 154(b) by 1144 days.

(21) Appl. No.: 16/772,086

(22) PCT Filed: Dec. 17, 2018

(86) PCT No.: PCT/EP2018/085206
§ 371 (c)(1),
(2) Date: Jun. 2, 2021

(87) PCT Pub. No.: WO2019/115826
PCT Pub. Date: Jun. 20, 2019

(65) Prior Publication Data

US 2021/0140121 A1 May 13, 2021

(30) Foreign Application Priority Data

Dec. 15, 2017 (GB) ..... 1721070
Apr. 27, 2018 (GB) ..... 1806885

(51) Int. Cl.

| | |
|---|---|
| ***E01B 21/00*** | (2006.01) |
| ***E01B 7/00*** | (2006.01) |
| ***E01B 7/02*** | (2006.01) |
| ***E01B 7/08*** | (2006.01) |
| ***E01B 21/02*** | (2006.01) |

(52) U.S. Cl.
CPC ..... *E01B 21/00* (2013.01); *E01B 7/00* (2013.01); *E01B 7/02* (2013.01); *E01B 7/08* (2013.01); *E01B 21/02* (2013.01)

(58) Field of Classification Search
CPC ... E01B 7/00; E01B 21/00; E01B 7/02; E01B 7/08; E01B 21/02
See application file for complete search history.

(56) References Cited

U.S. PATENT DOCUMENTS

2016/0024721 A1* 1/2016 Penny ..... E01B 7/00 246/415 R

FOREIGN PATENT DOCUMENTS

| | | | | |
|---|---|---|---|---|
| CN | 101 082 197 A | | 12/2007 | |
| EP | 2 520 711 A2 | | 11/2012 | |
| FR | 2849872 A1 | * | 7/2004 | ..... B62D 1/265 |
| GB | 2386882 A | * | 10/2003 | ..... E01B 2/00 |
| JP | 2010506065 A | * | 1/2016 | |
| WO | WO-03012203 A2 | * | 2/2003 | ..... E01B 19/003 |

(Continued)

*Primary Examiner* — S. Joseph Morano
*Assistant Examiner* — Cheng Lin
(74) *Attorney, Agent, or Firm* — patenttm.us

(57) ABSTRACT

A rail junction assembly (10) comprises a fixed rail portion (12) and a movable switch rail portion (14). The fixed rail portion (12) having a transfer region (26) which can be engaged by the switch rail portion (14) to effect transfer of a rail vehicle between the fixed and switch rail portions (12, 14). The switch rail portion (14) has an end region (28) movable into engagement with the transfer region (26) of the fixed rail portion (12). The transfer region (26) of the fixed rail portion (12) comprises an embedded rail portion embedded within an embedment (16).

19 Claims, 7 Drawing Sheets

(56) References Cited

FOREIGN PATENT DOCUMENTS

| | | | |
|---|---|---|---|
| WO | 2014/135852 | A1 | 9/2014 |
| WO | 2014/207339 | A1 | 12/2014 |

* cited by examiner

RAIL JUNCTION ASSEMBLY

This invention relates to rail junction assemblies. More specifically, but not exclusively, this invention relates to rail junction assemblies provided in embedded rail track systems.

Embedded rails may be used in railway lines, tramway or metro lines, and other suitable situations. Embedded rail track provides the advantages that it resiliently supports the rail while limiting rail roll, emits less noise, is less sensitive to adverse environmental conditions, may be continuously supported, and is retained safely in the unlikely event of a rail failure.

However, at locations in which rail junctions comprise fixed track and movable switch track, known embedded rail systems use flat bottom rails to ensure the fixed track is properly secured.

According to one aspect of this invention, there is provided a rail junction assembly comprising:

a fixed rail portion and a movable switch rail portion;

the fixed rail portion having a transfer region which can be engaged by the switch rail portion to effect transfer of a rail vehicle between the fixed and switch rail portions;

wherein the switch rail portion has an end region movable into engagement with the transfer region of the fixed rail portion; and wherein the fixed rail portion comprises an embedded rail portion at said transfer region.

As used herein, the phrase "embedded rail" or "embedded rail portion", are intended to mean a rail, or a portion of a rail, held within an embedment.

The embedment may hold the rail or the portion of the rail continuously or intermittently. The transfer region of the fixed rail portion may comprise an embedded rail portion embedded within an embedment.

The embedment may be an elongate socket in a substrate. The substrate may be formed of a material capable of supporting the applied loads to the required deflection tolerances. For example, the aforementioned material may comprise concrete or metal.

The embedment may further include an outer support casing supporting the rail or rail portion. The outer support casing may engage the substrate. A cushioning layer may be provided between the support casing and the rail or rail portion.

The fixed rail portion may comprise a main region attached to the transfer region to provide an elongate continuously extending rail. The transfer and main regions of the fixed rail portion may have respective inner faces to face the wheel flanges of a rail vehicle travelling along the rails.

The inner face of the transfer region may face towards the switch rail portion. The transfer and main regions of the fixed rail portion may have an outer face directed away from the switch rail portion.

The transfer region may have an attaching region attached to the main region.

The switch rail portion may be resilient. The switch rail portion may be resiliently movable into engagement with the fixed rail portion in the transfer region.

Alternatively, the switch rail portion may be pivotally movable into engagement with the fixed rail portion in the transfer region. The switch rail portion may be horizontally or vertically movable into engagement with the fixed rail portion in the transfer region.

The switch rail portion may have first and second faces extending from the end region of the switch rail portion. The first face of the switch rail portion may face towards the transfer region of the fixed rail portion. The second face of the switch rail portion may face away from the transfer region of the fixed rail portion.

The inner face of the transfer region, and the first face of the switch rail portion may be shaped to conform to each other. The first face of the switch rail portion may engage the fixed rail portion when the switch rail portion engages the transfer region of the fixed rail portion. When so engaged, the first face of the switch rail portion may engage the inner face of the fixed rail portion.

The switch rail portion may engage the fixed rail portion along the transfer region of the fixed rail portion. The inner face of the transfer region, and the first face of the switch rail portion may engage each other, and may conform to each other along the transfer region and along the switch rail portion.

The transfer region of the fixed rail portion may include an upper head portion. The inner face may include a first rail engaging surface for engaging the switch rail portion. The first rail engaging surface may slope from the upper head portion away from the switch rail portion.

The switch rail portion may include an upper elongate apex. The first face of the switch rail portion may include a second rail engaging surface for engaging the fixed rail portion. The second rail engaging surface may slope outwardly from the upper elongate apex towards the transfer region of the fixed rail portion.

The second rail engaging surface may engage the first rail engaging surface of the transfer region when the end region of the switch rail portion is moved into engagement with the transfer region of the fixed rail portion.

Each of the first and second rail engaging surfaces may have an upper region and a lower region. When the end region of the switch rail portion is moved into engagement with the transfer region of the fixed rail portion, the upper regions of the first and second rail engaging surfaces may engage each other and a gap may be defined between lower regions of the first and second rail engaging surfaces.

The first rail engaging surface may be substantially planar. The second rail engaging surface may be substantially planar.

The fixed rail portion may have a lower face. At the main region of the fixed rail portion, the embedment may extend across the lower face of the fixed rail portion. At the main region of the fixed rail, the embedment may extend upwardly from the lower face across the inner face by approximately 40% to 60% of the height of the fixed rail portion, preferably by approximately 50% of the height of the fixed rail portion.

At the transfer region of the fixed rail portion, a lower area of the embedment may extend across the lower face of the fixed rail portion. At the transfer region of the fixed rail portion of one embodiment, an inner area of the embedment may extend upwardly from the lower face across the inner face by approximately 5% to 30% of the height of the fixed rail portion, preferably by approximately 20% to 30% of the height of the fixed rail portion, more preferably by approximately 25% of the height of the fixed rail portion.

The end region of the switch rail portion may be movable into engagement with the transfer region of the fixed rail portion above said lower area of the embedment.

The switch rail portion may have a distal end, which may be a distal free end. The distal end may comprise a switch toe for engaging the transfer region. The first and second faces may taper towards each other to the switch toe. The switch rail may taper to a sharp end at the switch toe.

The switch rail portion may be attached to a further fixed rail portion. The switch rail portion may have a proximal end comprising a switch heel to attach the switch rail to the further fixed rail portion.

In one embodiment, the switch rail portion may be fixedly attached to the further fixed rail portion. In this embodiment, the switch rail portion may be integral with the further fixed rail portion. In another embodiment, the switch rail portion may be pivotally attached to the further fixed rail portion.

The switch rail portion may be configured so that the switch heel has the same size and shape as the further fixed rail portion. Thus, a smooth transition may be provided between the switch rail portion and the further fixed rail portion.

The switch rail portion may have a main part, which may be elongate. The switch rail portion may have a projecting member on the main part. The projecting member may be elongate. The projecting member may extend longitudinally along the main part. The projecting member may extend laterally from the second face.

The switch rail portion may have a lower face. The projecting member may be spaced above the lower face.

The projecting member may be attached to a drive mechanism to drive the switch rail into and out of engagement with the transfer region of the fixed rail.

The rail junction assembly may further include a slide member across which the switch rail portion can slide. The rail junction assembly may include a plurality of slide members.

The, or each, slide member may be a horizontal slide member. The slide member may extend from the fixed rail portion. The slide member may extend across the embedment. The projecting member may be spaced above the slide member.

The slide member may extend at an angle to the horizontal. Said angle may be between 1° and 5°, desirably 2°. Alternatively, the slide member may extend horizontally.

In one embodiment, where the slide member extends at an angle to the horizontal, the switch rail portion may either move horizontally thereby disengaging contact with the slide member along at least some of the movement of the switch rail portion, or the switch rail portion may slide at an angle to the horizontal, thereby remaining in contact with the slide member.

The switch rail portion may move horizontally, vertically or in a direction that is a combination of horizontally and vertically.

The switch rail portion may include a low friction element on the main part to facilitate the sliding movement of the switch rail portion across the slide member. The low friction element may be mounted on the main part across the lower face.

A sealing member may extend from the inner and outer faces of the fixed rail portion to or across the top of the embedment.

In one embodiment, the switch rail portion may include a fastener to fasten the projecting member to the main part. The fastener may be a bolt, such as a bolt having a countersunk head.

The rail junction assembly may comprise first and second of the fixed rails described above, and first and second of the switch rail portions. The rail junction assembly may comprise a spacer member extending between the first and second fixed rail portions.

The rail junction assembly may include a resilient member beneath the slide member.

Embodiments of the invention will now be described by way of example only, with reference to the accompanying drawings, in which.

Figure 1:
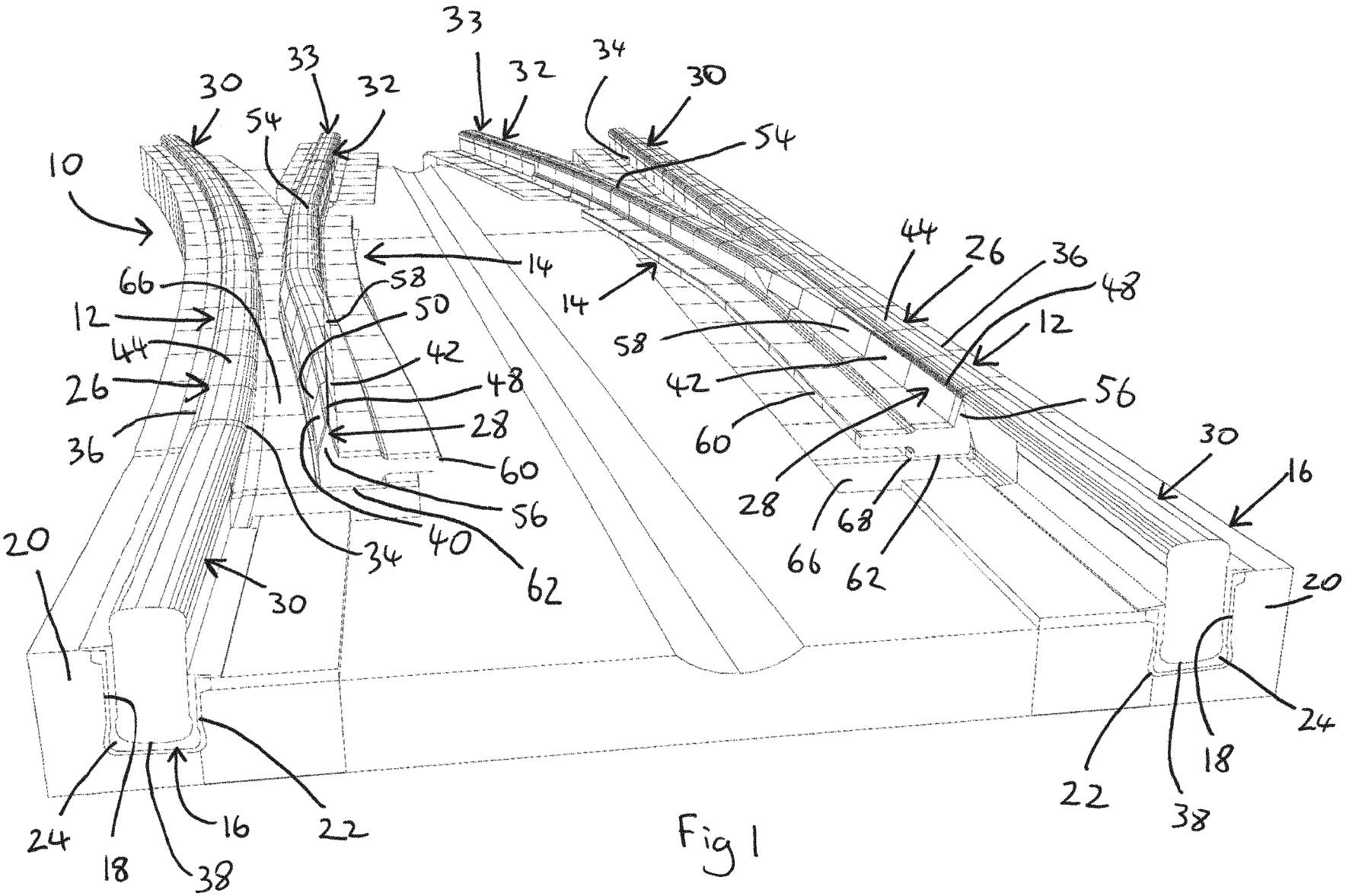
FIG. 1 is a perspective view of a rail junction assembly of a rail system, depicting the rails in a first direction.

Referring to the drawings, there is shown a rail junction assembly 10 comprising a fixed rail portion 12 and a movable switch rail portion 14. In the embodiment shown, both the fixed rail portion 12 and the switch rail portion 14 are part of longer rails. Each of the longer rails is in the form of an embedded rail.

The fixed rail portion 12 is embedded in an embedment 16, thereby constituting an embedded rail portion. The embedment 16 in which the fixed rail portion 12 is embedded comprises an elongate rail holding socket 18 formed in a concrete base 20.

The embedment 16 further includes an outer support casing 22 in the socket 18 in engagement with the concrete base 20. The support casing 22 provides support for the fixed rail portion 12. A cushioning layer 24 formed of an elastomeric material is provided between the support casing 22 and the fixed rail portion 12.

The fixed rail portion 12 has a transfer region 26 which can be engaged by the switch rail portion 14 to effect transfer of a rail vehicle, such as a train or a tram, from the fixed rail portion 12 onto the switch rail portion 14, or from the switch rail portion 14 onto the fixed rail portion 12.

The switch rail portion 14 has a tapered region 28 movable into engagement with the transfer region 26 of the fixed rail portion 12. In the embodiment shown, the switch rail portion 14 is movable horizontally into engagement with the transfer region 26 of the fixed rail portion.

The transfer region 26 of the fixed rail portion 12 is an embedded rail portion, being a region of the fixed rail portion 12 embedded in a region of the embedment 16.

In the embodiments shown, the rail junction assembly 10 comprises a pair of the fixed rail portions 12, and a pair of the movable switch rail portions 14, as would be understood by the person skilled in the art.

The majority of the present description discusses only one of the fixed rail portions 12 and one of the switch rail portions 14. The skilled person will realise that such description applies equally to both of the fixed rail portions 12 and both of the switch rail portions 14.

The fixed rail portion 12 comprises two main regions 30. Each of the main regions 30 is attached to a respective opposite end of the transfer region 26 to provide an elongate continuously extending rail. The switch rail portion 14 is attached to a further fixed rail portion 32 to provide a further continuously extending rail 33.

Each of the transfer and main regions 26, 30 of the fixed rail portion 12 have respective inner faces 34 to face the switch rail portion 14. The inner faces 34 of the transfer and main regions 26, 30 also face the wheel flanges of a rail vehicle (not shown) travelling along the rail. The transfer and main regions 26, 30 of the fixed rail portion 12 also have outer faces 36 directed away from the switch rail portion 14.

The fixed rail portion 12 has a lower face 38. A lower area 39 of the embedment 16 extends across the lower face 38. At the transfer and main regions 26, 30 of the fixed rail portion 12, an outer area 37 of the embedment 16 extends upwardly from the lower area 39 across the outer face 36 by approximately 75% of the height of the fixed rail portion 12.

Figure 2:
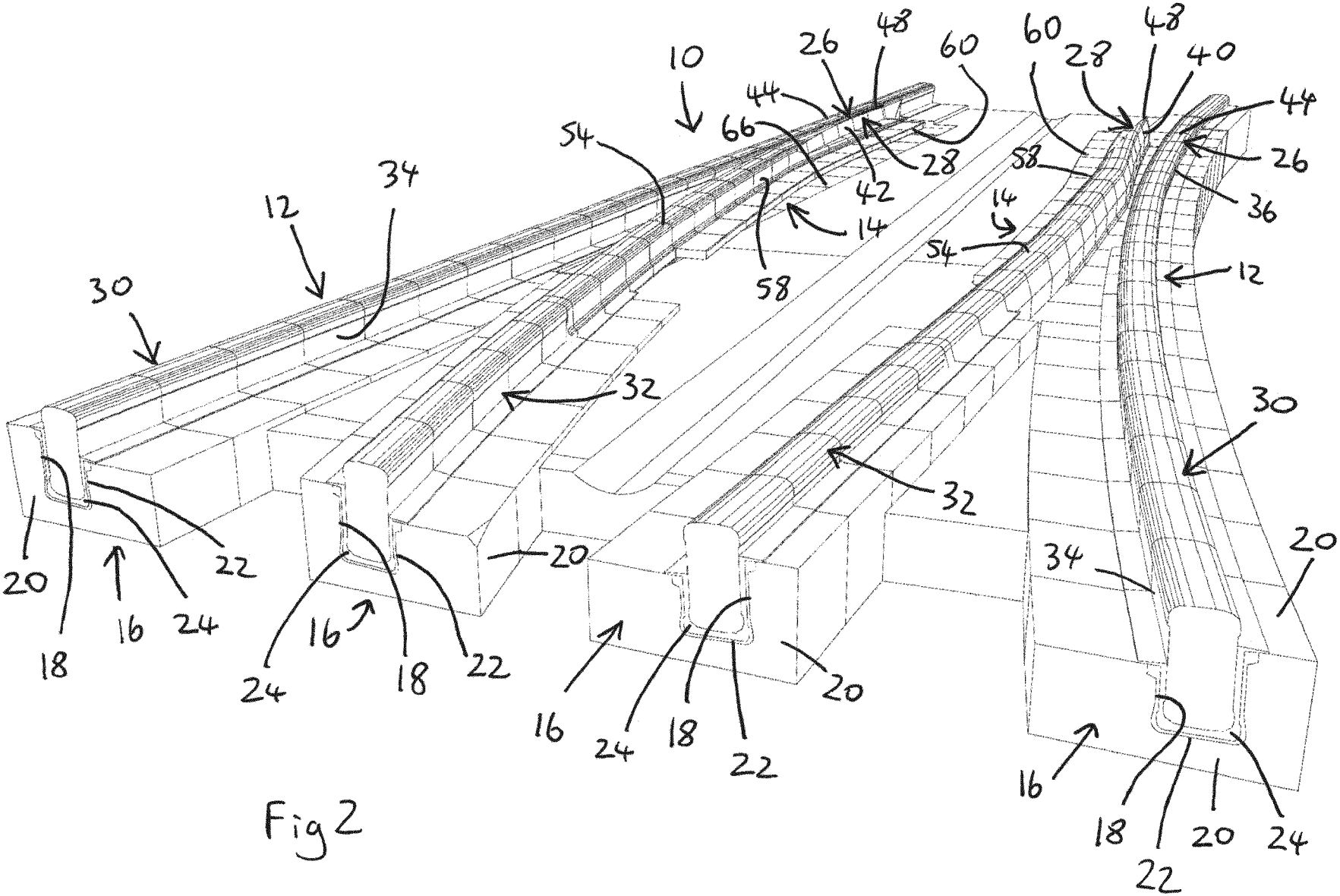
FIG. 2 is a perspective view of the rail junction assembly shown in FIG. 1, depicting the rails in a second, opposite direction.
Figure 3:
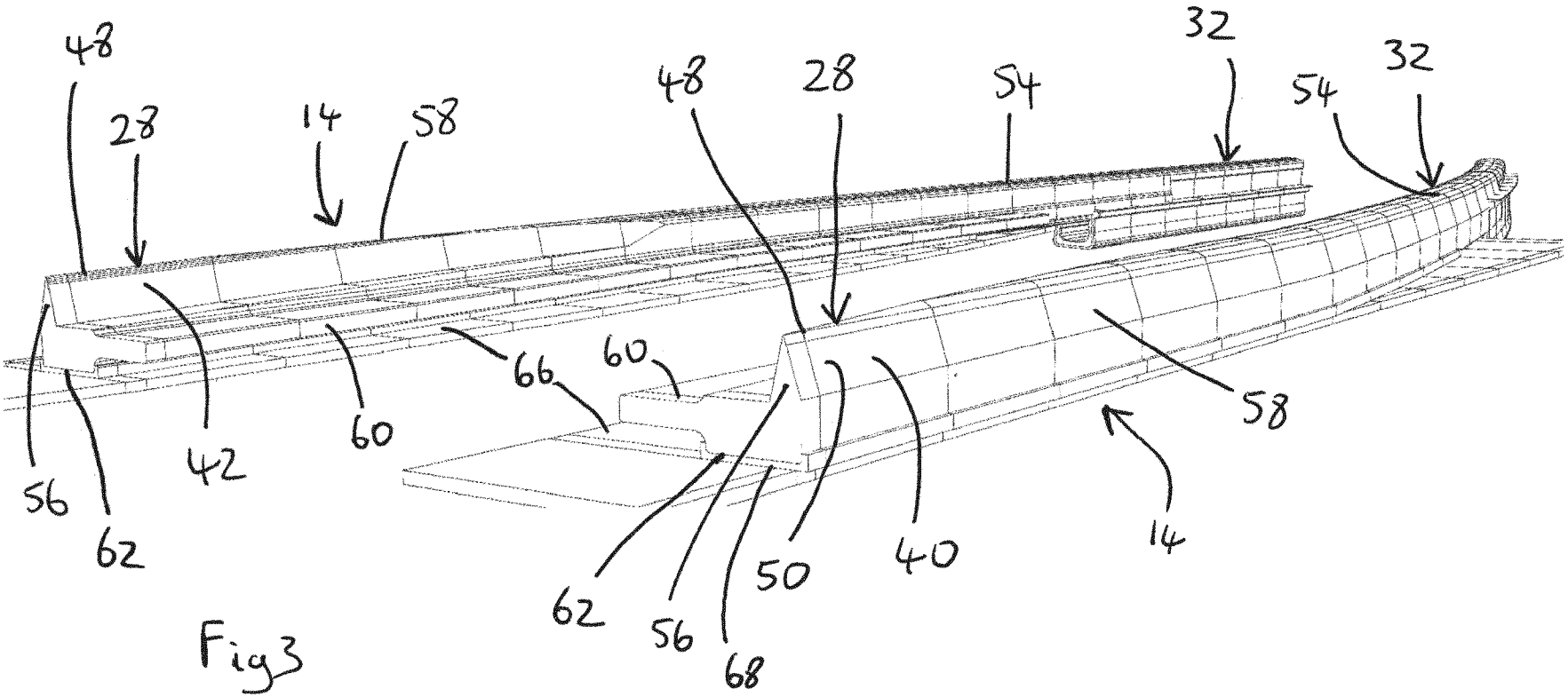
FIG. 3 is a perspective of switch rail portions of the rail junction assembly, depicting the switch rail portions in a first direction.
Figure 4:
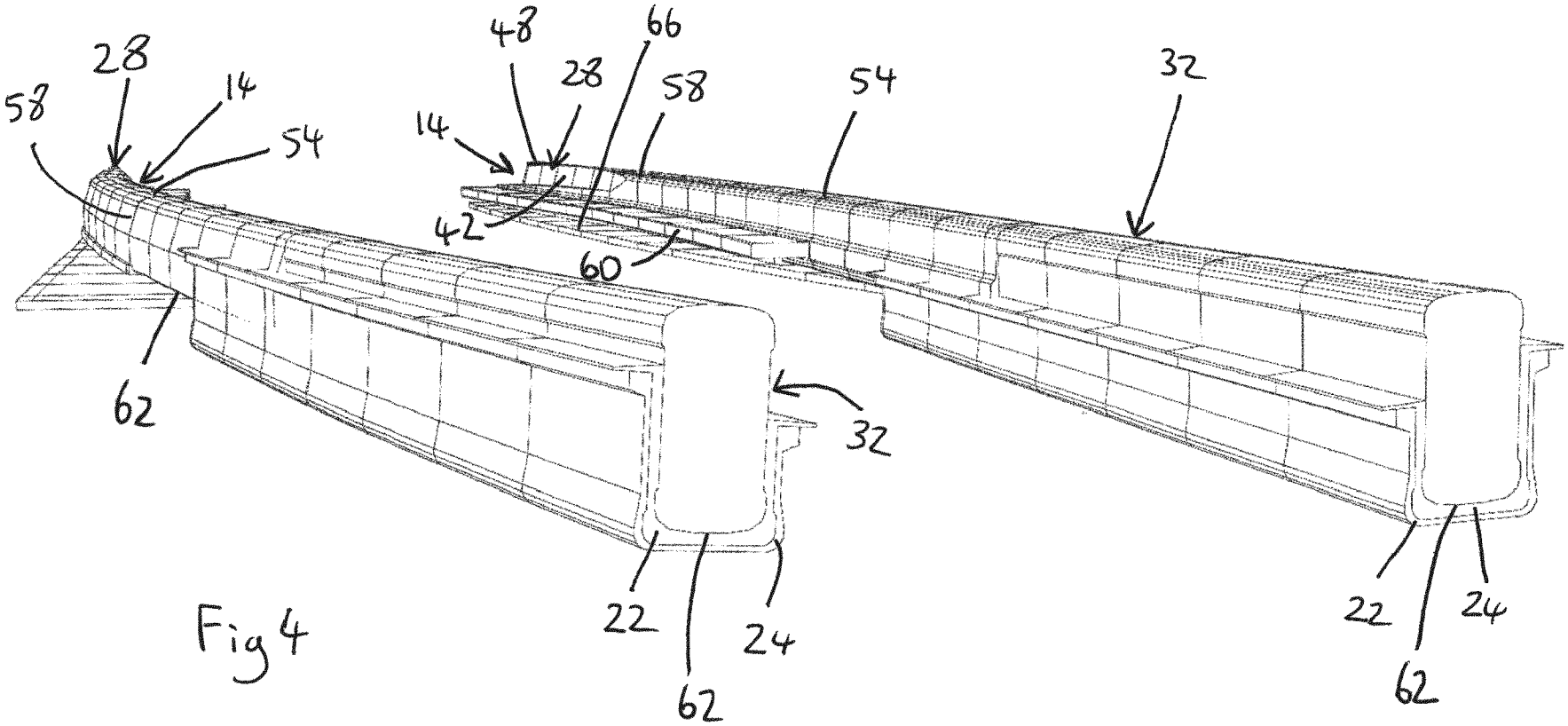
FIG. 4 is a perspective of the switch rail portions of the rail junction assembly, depicting the switch rail portions in a second, opposite direction.
Figure 5:
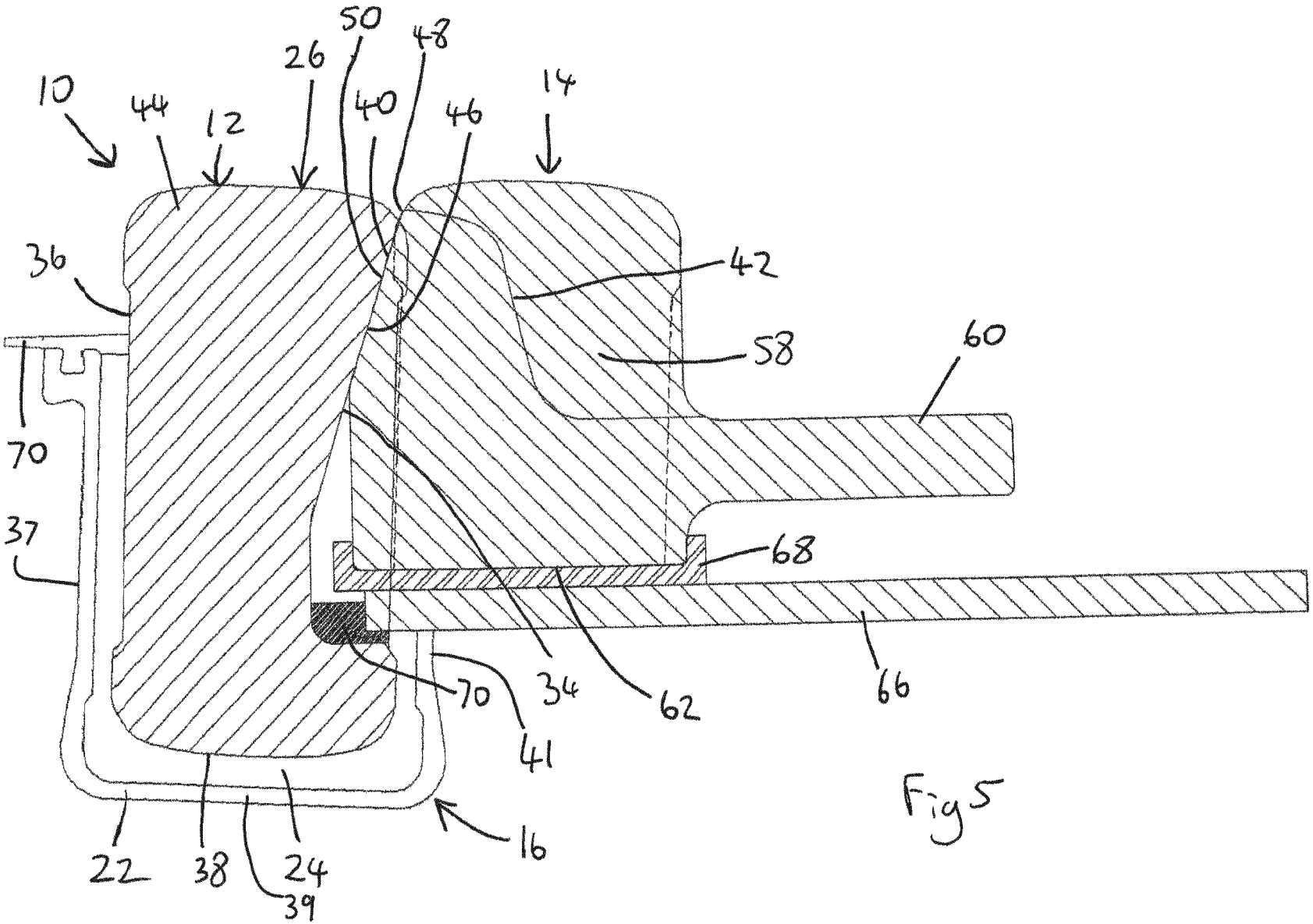
FIG. 5 is an end sectional view of a fixed rail portion and a switch rail portion forming part of a first embodiment of the rail junction assembly.

As shown in FIGS. 1 and 2, at the main region 30, the embedment 16 extends upwardly from the lower face 38 across the inner face 34 by approximately 50% of the height of the fixed rail portion 12. As shown in FIG. 5, at the transfer region 26, an inner area 41 of the embedment 16 extends upwardly from the lower area 39 across the inner face 34 by approximately 25% of the height of the fixed rail portion 12.

Figure 6:
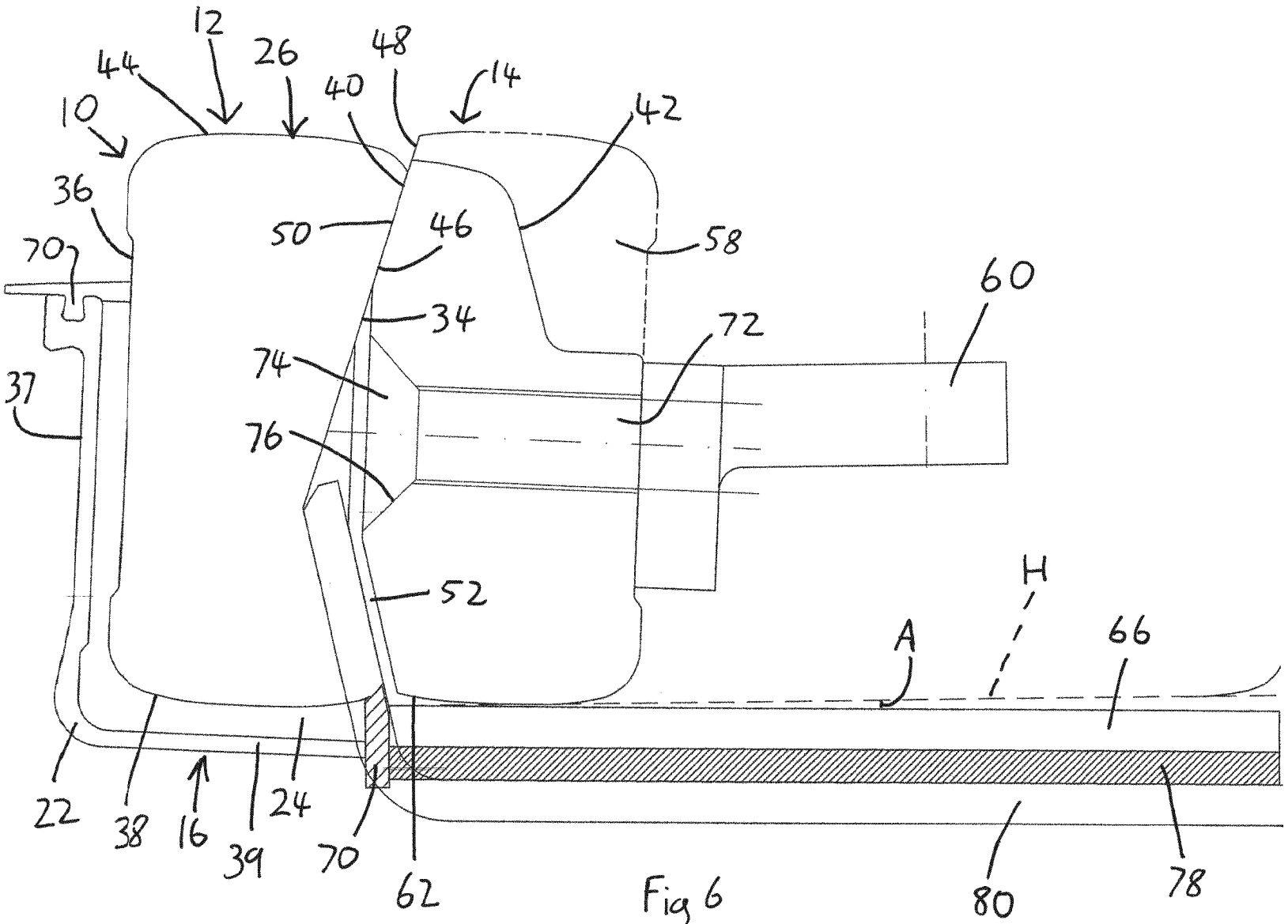
FIG. 6 is an end sectional view of a fixed rail portion and a switch rail portion forming part of a second embodiment of the rail junction assembly.

Thus, comparing FIGS. 1 and 2 with FIG. 6, although the transfer region 26 of the fixed rail portion 12 is embedded, the embedment 16 extends across the inner face 34 of the transfer region 26 to a lesser extent than the inner face 34 of the main region 30. In the transfer region 26, an upper area 35 of approximately 75% of the inner face 34 is devoid of the embedment 16.

The switch rail portion 14 has first and second faces 40, 42 which face in opposite directions. The first face 40 of the switch rail portion 14 faces towards the transfer region 26 of the fixed rail portion 12. The second face 42 of the switch rail portion 14 faces away from the transfer region 26 of the fixed rail portion 12.

The inner face 34 of the transfer region 26, and the first face 40 of the switch rail portion 14 are shaped to conform to each other, thereby allowing them to engage each other in intimate contact. The switch rail portion 14 engages the fixed rail portion 12 along the length of the transfer region 26.

The tapered region 28 of the switch rail portion 14 is movable into engagement with the transfer region 26 of the fixed rail portion 12 above said lower area 39 of the embedment 16 and above the inner area 41 of the embedment 16.

In order to effect the aforesaid conformation of the inner face 34 and the first face 40, the transfer region 26 includes an upper head portion 44, and the inner face 34 includes a substantially planar first rail engaging surface 46 for engaging the switch rail portion 14. The first rail engaging surface 46 slopes from the upper head portion 44 inwardly of the transfer region 26 away from the switch rail portion 14.

The switch rail portion 14 includes an upper elongate apex 48. The first face 40 of the switch rail portion 14 includes a substantially planar second rail engaging surface 50. The second rail engaging surface 50 slopes outwardly from the upper elongate apex 48 towards the transfer region 26 of the fixed rail portion 12.

The first and second rail engaging surfaces 46, 50 engage each other when the end region 28 of the switch rail portion 14 is moved into engagement with the transfer region 26 of the fixed rail portion 12.

The switch rail portion 14 is attached to the further fixed rail portion 32 at a proximal end 54 of the switch rail portion 14. The proximal end 54 of the switch rail portion 14 comprises a switch heel to attach the switch rail portion 14 to the further fixed rail portion 32.

The switch rail portion 14 is configured so that the end profile of the proximal end 54 has the same size and shape as the end profile of the further fixed rail portion 32. Thus, when the proximal end 54 of the switch rail portion 14 is welded to the end of the further fixed rail portion 32, a smooth transition is provided between the switch rail portion 14 and the further fixed rail portion 32.

The tapered region 28 has a distal free end 56. The distal free end 56 comprises a switch toe. The first and second faces 40, 42 of the switch rail portion taper towards each other to meet at the distal free end 56.

The switch rail portion 14 has an elongate main part 58 and an elongate projecting member 60 on the main part 58. The projecting member 60 extends longitudinally along the main part 58 and extends laterally from the second face 42.

The switch rail portion 14 has a lower face 62. The projecting member 60 is spaced upwardly along the inner face 34 from the lower face 62.

The rail junction assembly 10 further includes a drive mechanism (not shown) attached to the projecting member 60 to drive the switch rail portion 14 into and out of engagement with the transfer region 26 of the fixed rail portion 12. The drive mechanism extends between the two switch rail portions 14, thereby driving both of them.

Alternatively, the drive mechanism may be provided in a region spaced from the rail junction assembly 10. A rod arrangement may be provided to extend from the drive mechanism to the switch rail portions 14 to control movement of the switch rail portions 14.

The drive mechanism may be configured to move the switch rails portions 14 at the same time, or sequentially. In the case of sequential movement, the switch rail portions 14 may move together for part of the movement, or independently.

The rail junction assembly 10 further includes a slide member 66 across which the switch rail portion 14 can slide. The slide member 66 extends laterally from the transfer region 26 of the fixed rail portion 12 across the embedment 16.

In the embodiment shown, the slide member 66 extends at an angle A to the horizontal. The angle A may be between 1° and 5°, for example 2°. In FIG. 6, the horizontal is indicated by the broken line H. Alternatively, the slide member 66 may extend horizontally.

In the embodiment shown, where the slide member 66 extends at an angle to the horizontal, the switch rail portion 14 moves horizontally thereby disengaging contact with the slide member 66 along at least some of the movement of the switch rail portion 14.

Alternatively in the same embodiment, or in another embodiment, the switch rail portion 14 slides at an angle to the horizontal, thereby remaining in contact with the slide member 66.

As can be seen from FIGS. 5 and 6, the projecting member 60 is spaced above lower face 38 of the switch rail portion 14 and is also spaced above the slide member 66. This allows the drive mechanism to be attached to the projecting member 60.

The switch rail portion 14 further includes a low friction element 68 arranged across the lower face 62 on the main part 58. The low friction element 68 is slidable across the slide member 66 and thereby facilitates the sliding movement of the switch rail portion 14 across the slide member 66.

In order to prevent water, oil and dirt from entering the embedment 16, a respective sealing member 70 extends from the inner and outer faces 36 of the fixed rail portion 12 across the top of the embedment 16, as shown in FIGS. 5 and 6.

In use, the drive mechanism moves the switch rail portion 14 towards the transfer region 26. The switch rail portion 14 engages the transfer region 26 by deformation of the switch rail portion 14 relative to the main rail portion 32.

The absence of the embedment 16 from the upper area 35 of the inner face 34 of transfer region 26 allows upper regions of the first and second rail engaging surfaces 46, 50 to engage each other in the aforesaid intimate contact.

As shown in FIG. 6, when the upper regions of the first and second rail engaging surfaces 46, 50 engage each other, a gap 52 is defined between lower regions of the first and second rail engaging surfaces 46, 50.

The drive mechanism can also move the switch rail portion 14 away from the transfer region 26.

There is thus described a rail junction assembly 10 that provides an embedded rail system with junctions that incorporate movable embedded rails, and avoids the need to provide different types of rail at the junctions.

Various modifications can be made without departing from the scope of the invention. For example, the switch rail portion 14 may be vertically movable, or may have a vertical component to the movement.

In a further modification, as shown in FIG. 6, the switch rail portion 14 can include a fastener to fasten a separate projecting member 60 to the main part 58. The fastener is a bolt 72 having a countersunk head. Also in the embodiment shown in FIG. 6, a resilient member 78 formed of an elastomeric material is provided beneath the slide member 66.

The bolt 72 extends through main part 58 of the switch rail portion 14. The bolt 72 has a bolt head 74 is received in a recess 76 in the main part 58.

In the embodiment shown in FIG. 6, a spacer member 80 extends between the two fixed rail portions 12 to maintain the fixed rail portions 12 at a constant spacing. The spacer member 80 constitutes a brace to hold the fixed rail portions 12 in position.

Only one fixed rail portion 12 is shown in FIG. 6, but the skilled person will be immediately aware of the position of the other fixed rail portion 12.

At the transfer region 26 of the fixed rail portion 12 of this embodiment, the outer area 37 of the embedment 16 extends across the outer face 36 of the fixed rail portion 12, and the lower area 39 of the embedment 16 extends across the lower face 38. However, the inner area 41 of the embedment 16 is absent to allow the spacer member 80 to be arranged as shown.

Figure 7:
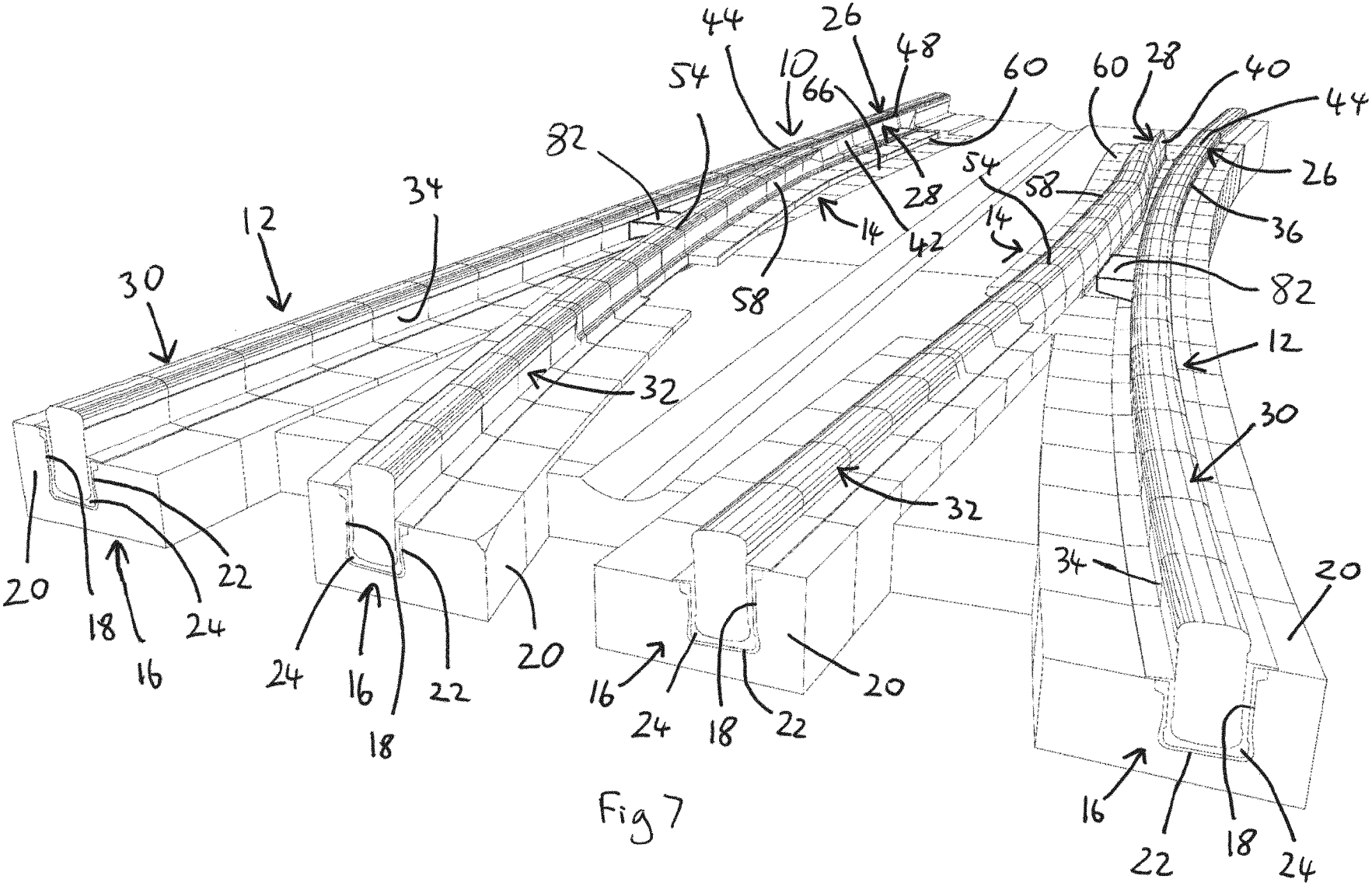
FIG. 7 is a view similar to the view in FIG. 2, showing a modified rail junction assembly.

In another modification, shown in FIG. 7, the rail junction assembly 10 may include a stop member 82 provided on the fixed rail portion 12. The stop member 82 extends from the inner face 34 towards the switch rail portion 14.

When the switch rail portion 14 engages the transfer region 26 of the fixed rail portion 12, the switch rail portion 14 also engages the stop member 82. The stop member 82 provides lateral support to the switch rail portion 14 as the wheels of the rail vehicle pass along the switch rail portion 14.

The invention claimed is:

1. A rail junction assembly comprising:

a fixed rail portion and a movable switch rail portion;

the fixed rail portion having a transfer region which can be engaged by the switch rail portion to effect transfer of a rail vehicle between the fixed and switch rail portions;

wherein the switch rail portion has an end region movable into engagement with the transfer region of the fixed rail portion; and wherein the transfer region of the fixed rail portion comprises an embedded rail portion embedded within an embedment;

wherein the switch rail portion has first and second faces extending from the end region of the switch rail portion, the first face of the switch rail portion facing towards the transfer region of the fixed rail portion, and the second face of the switch rail portion facing away from the transfer region of the fixed rail portion.

2. A rail junction assembly according to claim 1, wherein the first face of the switch rail portion engages the fixed rail portion when the switch rail portion engages the transfer region of the fixed rail portion, and wherein when the switch rail portion engages the transfer region of the fixed rail portion, the first face of the switch rail portion engages the inner face of the fixed rail portion.

3. A rail junction assembly according to claim 1, wherein the first face of the switch rail portion engages the fixed rail portion when the switch rail portion engages the transfer region of the fixed rail portion, and wherein the switch rail portion engages the fixed rail portion along the transfer region of the fixed rail portion, the inner face of the transfer region and the first face of the switch rail portion engaging, and conforming to, each other each other along the transfer region and along the switch rail portion.

4. A rail junction assembly according to claim 1, wherein the switch rail portion includes an upper elongate apex, the first face of the switch rail portion including a second rail engaging surface for engaging the fixed rail portion, and wherein the second rail engaging surface slopes outwardly from the upper elongate apex towards the transfer region of the fixed rail portion.

5. A rail junction assembly according to claim 1, wherein the fixed rail portion has a main region and a lower face, the embedment extends across the lower face of the fixed rail portion at the main region of the fixed rail portion.

6. A rail junction assembly according to claim 5, wherein, at the main region of the fixed rail portion, the embedment extends upwardly from the lower face of the fixed rail portion across the inner face by approximately 40% to 60% of the height of the fixed rail portion.

7. A rail junction assembly according to claim 5, wherein, at the transfer region of the fixed rail portion, a lower area of the embedment extends across the lower face of the fixed rail portion.

8. A rail junction assembly according to claim 7, wherein, at the transfer region of the fixed rail portion, an inner area of the embedment extends upwardly from the lower face of the fixed rail portion across the inner face by approximately 5% to 30% of the height of the fixed rail portion.

9. A rail junction assembly according to claim 7, wherein the end region of the switch rail portion is movable into engagement with the transfer region of the fixed rail portion above said lower area of the embedment.

10. A rail junction assembly according to claim 9, wherein the switch rail portion has a distal free end, the distal free end comprising a switch toe for engaging the transfer region, the first and second faces tapering towards each other to the switch toe.

11. A rail junction assembly according to claim 10, wherein the switch rail portion is attached to a further fixed rail portion, the switch rail portion having a proximal end comprising a switch heel to attach the switch rail to the further fixed rail portion.

12. A rail junction assembly according to claim 11, wherein the switch rail portion is configured so that the switch heel has the same size and shape as the further fixed rail portion.

13. A rail junction assembly according to claim 1, wherein the switch rail portion has an elongate main part, and an elongate projecting member on the main part, the projecting member extending longitudinally along the main part, and the projecting member extending laterally from the second face.

14. A rail junction assembly according to claim 13, wherein the switch rail portion includes a fastener to fasten the projecting member to the main part.

15. A rail junction assembly according to claim 13, wherein the switch rail portion has a lower face, and the projecting member is spaced above the lower face of the switch rail portion.

16. A rail junction assembly according to claim 13, wherein the projecting member is attached to a drive mechanism to drive the switch rail into and out of engagement with the transfer region of the fixed rail.

17. A rail junction assembly according to claim 1, further including a slide member across which the switch rail portion can slide, the slide member extending from the fixed rail portion, and the slide member extending across the embedment, and the rail junction assembly includes a resilient member beneath the slide member.

18. A rail junction assembly according to claim 17, wherein the switch rail portion has an elongate main part, and an elongate projecting member on the main part, the projecting member extending longitudinally along the main part, and the projecting member extending laterally from the second face, and the switch rail portion includes a low friction element on the main part to facilitate the sliding movement of the switch rail portion across the slide member.

19. A rail junction assembly according to claim 18, wherein the switch rail portion has a lower face, and the projecting member is spaced above the lower face of the switch rail portion, and the low friction element is mounted on the main part across the lower face.

* * * * *